US005184587A

United States Patent [19]

Ozeki

[11] Patent Number: 5,184,587

[45] Date of Patent: Feb. 9, 1993

[54] OIL PASSAGE STRUCTURE OF A CYLINDER HEAD

[75] Inventor: Hisashi Ozeki, Shizuoka, Japan

[73] Assignee: Suzuki Motor Corporation, Shizuoka, Japan

[21] Appl. No.: 845,228

[22] Filed: Mar. 3, 1992

[30] Foreign Application Priority Data

Mar. 20, 1991 [JP] Japan ..... 3-81753

[51] Int. Cl.[5] ..... F02F 1/00

[52] U.S. Cl. ..... 123/193.5; 123/193.3

[58] Field of Search ..... 123/193.5, 193.3, 90.27, 123/41.82, 196 M, 195 R, 195 AC

[56] References Cited

U.S. PATENT DOCUMENTS 4,497,289 2/1985 Bortolussi ..... 123/193.5
4,612,885 9/1986 Yoshikawa ..... 123/193.3
4,649,873 3/1987 Amano ..... 123/193.5
4,848,292 7/1989 Holtzberg ..... 123/193.3
4,955,337 9/1990 Kelly ..... 123/193.3
5,038,732 8/1991 Matayoshi et al. ..... 123/193.5
5,069,176 12/1991 Ruf et al. ..... 123/193.3

FOREIGN PATENT DOCUMENTS 54-127945 2/1953 Japan .

*Primary Examiner*—Noah P. Kamen
*Attorney, Agent, or Firm*—Flynn, Thiel, Boutell & Tanis

[57] ABSTRACT

A cylinder head is provided with bolt hole portions for permitting cylinder head bolts to attach the cylinder head to a cylinder block of an engine, and the height of the bearing surfaces of the bolt hole portions is set to a large value so that an oil passage extending in the longitudinal direction of the cam chamber of the engine is provided in the lower portion of the elevated bearing surfaces.

3 Claims, 8 Drawing Sheets

OIL PASSAGE STRUCTURE OF A CYLINDER HEAD

FIELD OF THE INVENTION

The invention relates to an oil passage structure of a cylinder head and, more particularly, to an oil passage structure of a cylinder head which is provided so as to perform lubrication in a cam chamber formed in the upper portion of the cylinder head.

BACKGROUND OF THE INVENTION

Engines are classified into the type in which cylinders are serially connected, the type in which cylinders are connected so as to face each other, the V type, and the like in accordance with the arrangement of the cylinders. The V-type engine has a first cylinder bank on one side and a second cylinder bank on the other side. As a V-type engine, there is also a lateral mounting type in which the first and second cylinder banks are installed so as to be located on the front and rear sides with respect to the progressing direction of the vehicle.

There is an oil passage structure of a cylinder head disclosed in the Official Gazette of Japanese Utility Model Registration Application Laid-Open No. 54-127945. According to a valve portion lubricating apparatus of an engine disclosed in the above Official Gazette, an oil pan is provided in a cam portion of a single overhead cam mechanism of the front inclined type engine, a predetermined depth is set in a rear side wall of the oil pan, and a slit is formed so as not to lower the height of the oil surface in the oil pan.

In the conventional oil passage structure of the cylinder head, as shown in FIGS. 8-11, a cam chamber 144 is formed in the upper portion of a cylinder head 108. A plurality of bolt hole portions 140 for cylinder head bolts (not shown) are formed on the exhaust (EX) side of the cam chamber 144. A side wall 146 of the cam chamber 144 is formed so as to isolate the chamber 144 from the cylinder head bolts. An oil passage 142 appears in the inner surface and in the lower portion of the side wall 146 when it is used. Since the side wall 146 of the cam chamber 144 is away from the cylinder head bolts, namely, it is projected toward the intake side, a weir (i.e., barrier) 160 is formed in the lower portion of the oil passage 142. Similarly, the weir 160 is also formed adjacent the bolt hole portions 140. A concave portion 162 is formed in the lower portion of the oil passage 142 by the weir 160.

Thus, there is an inconvenience because the oil can remain in the concave portions such that the oil flow deteriorates and defective oil lubrication is caused. There are also inconveniences in that dust, sludge and the like which are conveyed by the oil precipitate and are deposited in the concave portions and become factors to deteriorate the oil. Therefore, the useful life of the oil becomes short and the frequency of oil changes increases, which is economically disadvantageous. Further, since a pulsation (i.e., turbulence) occurs in the oil as it flows by the concave portions, air can be mixed into the oil easily, and various disadvantages are caused by the air mixture.

In an attempt to eliminate the above inconveniences, in an oil passage provided on the exhaust side of the cylinder head to perform lubrication in a cam chamber which is formed in the upper portion of the cylinder head, the invention is characterized in that bolt hole portions for cylinder head bolts to attach the cylinder head to a cylinder block are provided, the height of a bearing surface of each bolt hole portion is set to a large value, and the oil passage extending in the longitudinal direction of the cam chamber of the engine is provided in the cylinder head below the bearing surface.

According to the invention as mentioned above, the oil smoothly flows in the oil passage in the cam chamber of the cylinder head. Inadequate lubrication can be prevented. Amounts of precipitation and deposition of dust, sludge and the like which are conveyed by the oil are reduced. The amount of air mixed into the oil is reduced.

BRIEF DESCRIPTION OF THE DRAWINGS

An embodiment of the invention will be described in detail hereinbelow on the basis of the drawings.

DETAILED DESCRIPTION

Figure 1:
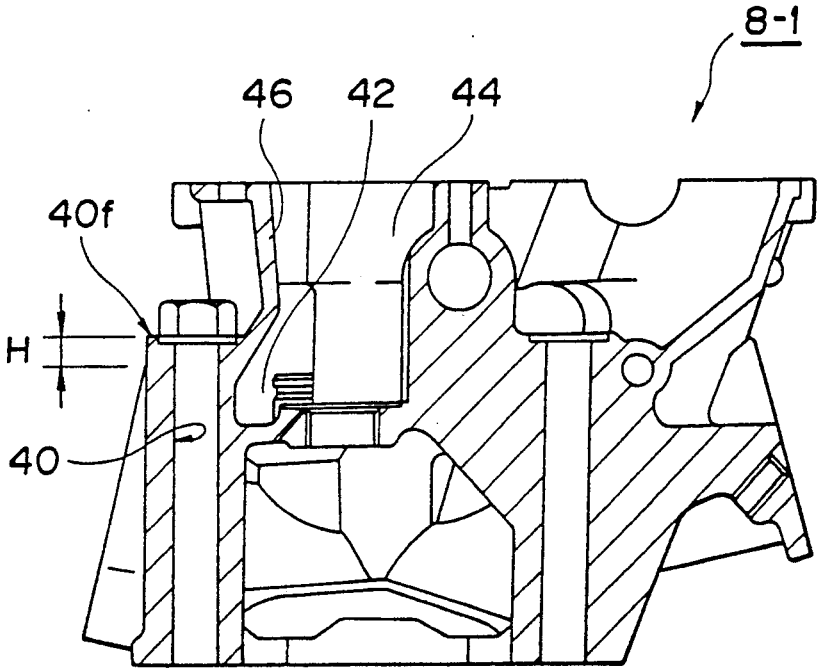
FIG. 1 is a cross-sectional view taken along the line I—I in FIG. 3 showing an embodiment of the invention.
Figure 2:
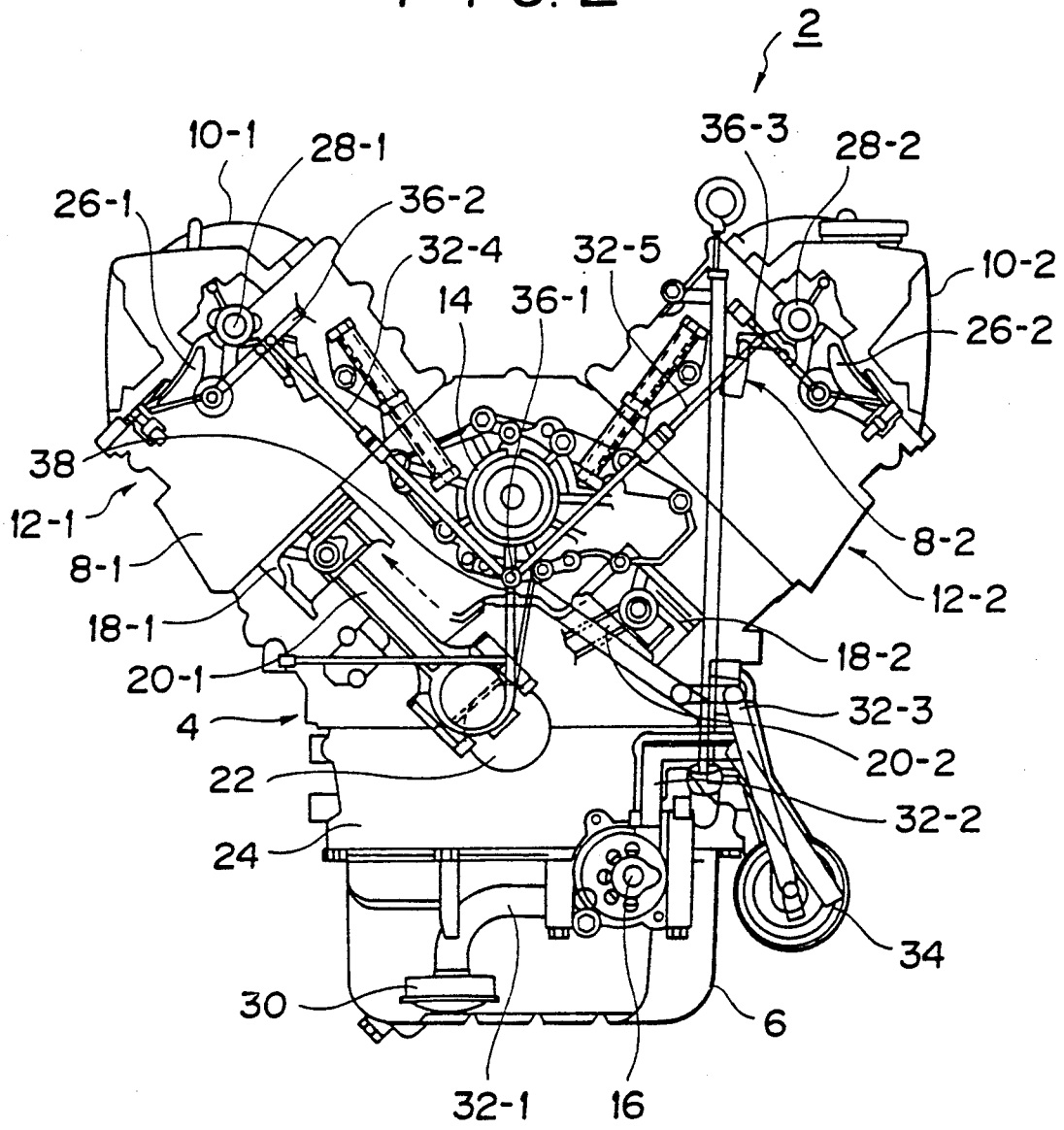
FIG. 2 is a schematic view of a V-type engine in which the invention is used.
Figure 3:
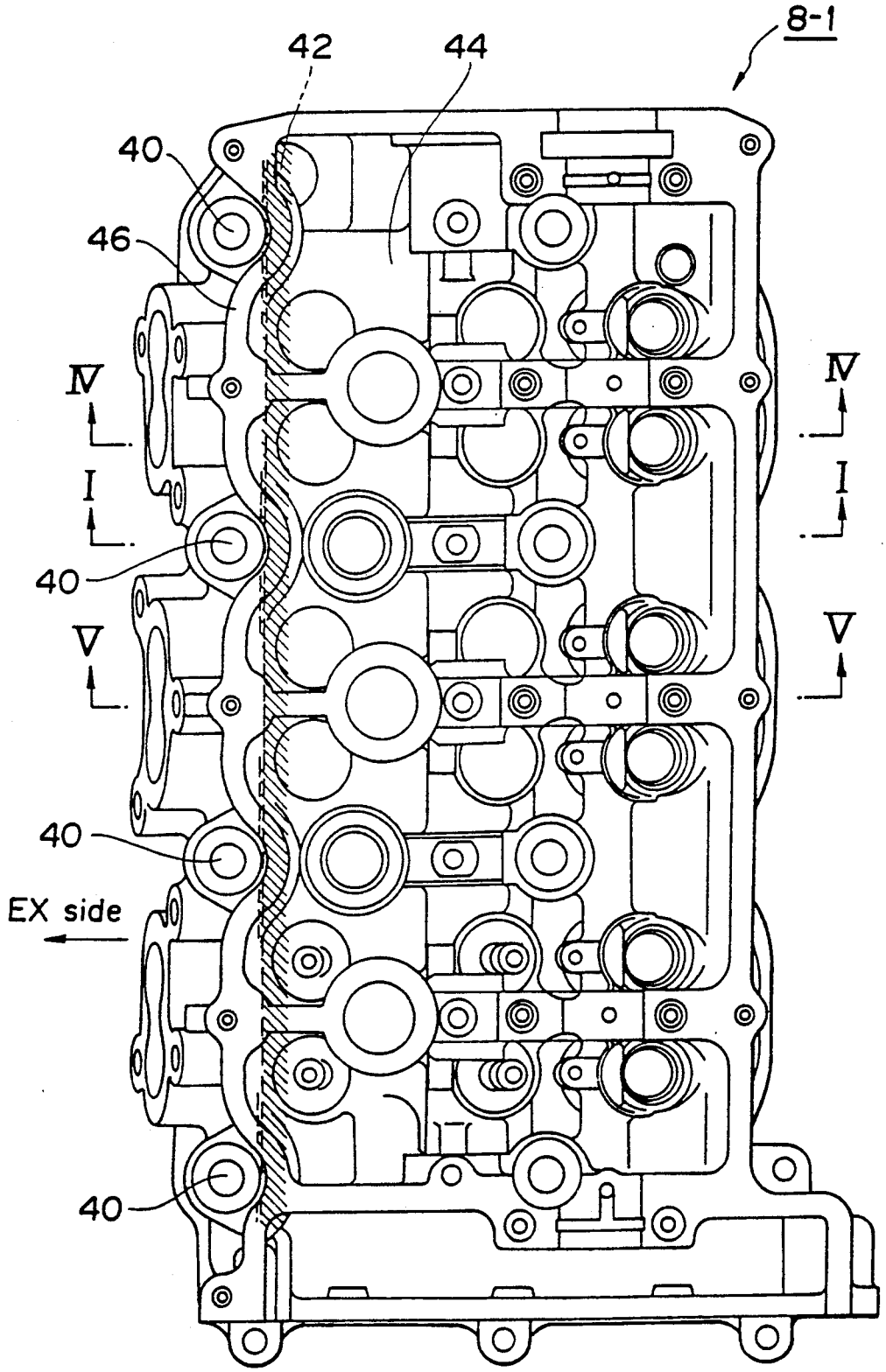
FIG. 3 is a plan view of a cylinder head of the FIG. 2 engine.
Figure 4:
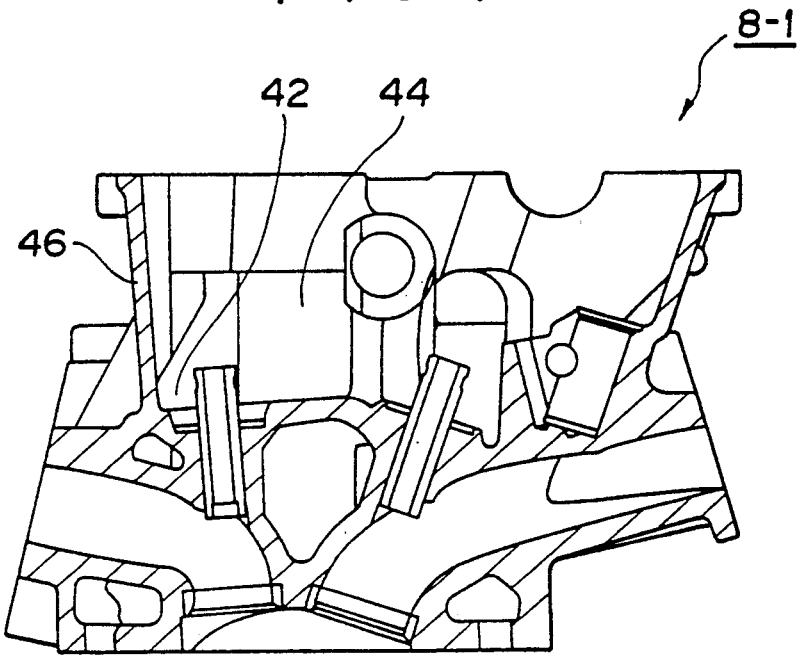
FIG. 4 is a cross-sectional view taken along the line IV—IV in FIG. 3.
Figure 5:
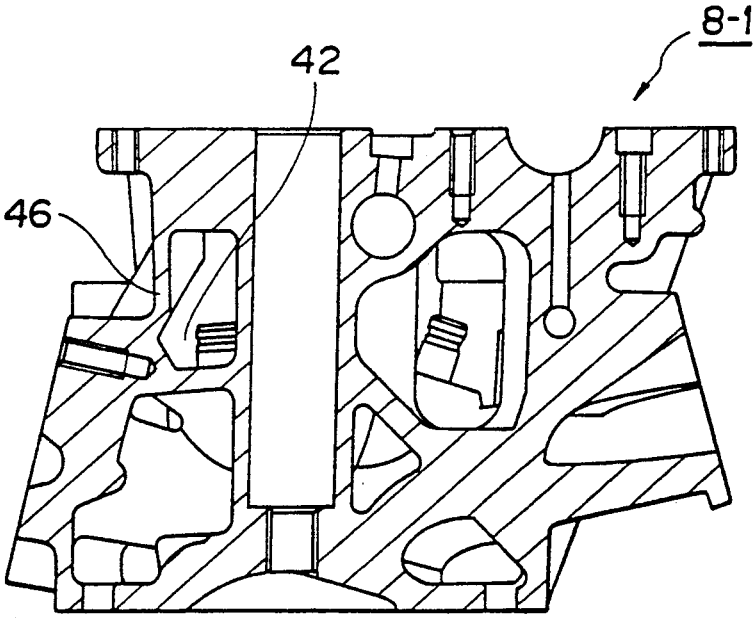
FIG. 5 is a cross-sectional view taken along the line V—V in FIG. 3.

FIGS. 1-7 show an embodiment of the invention. In FIG. 2, reference numeral 2 denotes a V-type engine. The V-type engine 2 is constructed in a manner such that an oil pan 6 is attached to the lower portion of a V-type cylinder block 4, and first and second cylinder heads 8-1 and 8-2 and first and second cylinder head covers 10-1 and 10-2 are mounted on the upper portion of the cylinder block 4. The first cylinder head 8-1 and the first cylinder head cover 10-1 are arranged on one side (left side in FIG. 2) of the V-type engine 2. The second cylinder head 8-2 and the second cylinder head cover 10-2 are arranged on the other side (right side in FIG. 2) of the V-type engine 2. By such mounting of the first and second cylinder heads 8-1 and 8-2, first and second cylinder banks 12-1 and 12-2 are defined on opposite sides of the engine and arranged in a V-character shape. The V-type engine 2 is installed in a vehicle engine compartment (not shown) so that the first and second cylinder banks 12-1 and 12-2 are respectively arranged, for example, on the front and rear sides with respect to the progressing direction of the vehicle.

In the cylinder block 4 to which a water pump 14 and an oil pump 16 are fixed, a first piston 18-1 is arranged on the first cylinder bank 12-1 side and a second piston 18-2 is arranged on the second cylinder bank 12-2 side. The first and second pistons 18-1 and 18-2 are coupled to a crank shaft 22 through first and second connecting rods 20-1 and 20-2. The crank shaft 22 is axially supported for rotation relative to the cylinder block 4 by a bearing cap 24.

A first rocker arm 26-1 and a first cam shaft 28-1 serving as a valve moving mechanism are arranged in the first cylinder head 8-1. A second rocker arm 26-2 and a second cam shaft 28-2 are arranged in the second cylinder head 8-2.

Further, the oil pump 16 fixed to the lower portion of the cylinder block 4 is coupled with an oil strainer 30 arranged in the oil pan 6 by a first communicating passage 32-1 and is also communicated with an oil filter 34 by a second communicating passage 32-2. The oil filter 34 is communicated with a first oil lubricating passage 36-1 in the cylinder block 4 by a third communicating passage 32-3. The first oil lubricating passage 36-1 is communicated with a second oil lubricating passage 36-2-.- in the first cylinder head 8-1 by a fourth communicating passage 32-4. The passage 36-1 is also communicated with a third oil lubricating passage 36-3 in the second cylinder head 8-2 by a fifth communicating passage 32-5.

An oil jet 38 to inject the oil for cooling the first and second pistons 18-1 and 18-2 is attached to the first oil lubricating passage 36-1. The oil jet 38 is formed by making a diameter of the injecting portion on one side of the oil jet 38 different from a diameter of the injecting portion on the other side, thereby almost equalizing a temperature of the first piston 18-1 on the one side and a temperature of the second piston 18-2 on the other side. Explaining in more detail, the diameter of the injecting portion for piston 18-2 on the other side is larger than the diameter of the injecting portion for piston 18-1 on the one side.

Bolt hold portions 40 (FIGS. 1 and 3) are provided for cylinder head bolts to attach the cylinder head 8 to the cylinder block 4. A height H of a bearing surface 40*f* of the bolt hold portion 40 is set to a large value. An oil passage 42 extending in the longitudinal direction of a cam chamber 44, which will be explained hereinlater, is provided in the cylinder head 8 in the lower portion of (i.e., below) the bearing surface 40*f*.

Since the first and second cylinder heads 8-1 and 8-2 are arranged in a line symmetrical shape, only the first cylinder head 8-1 side will be explained and the description of the second cylinder head 8-2 side is omitted.

Figure 9:
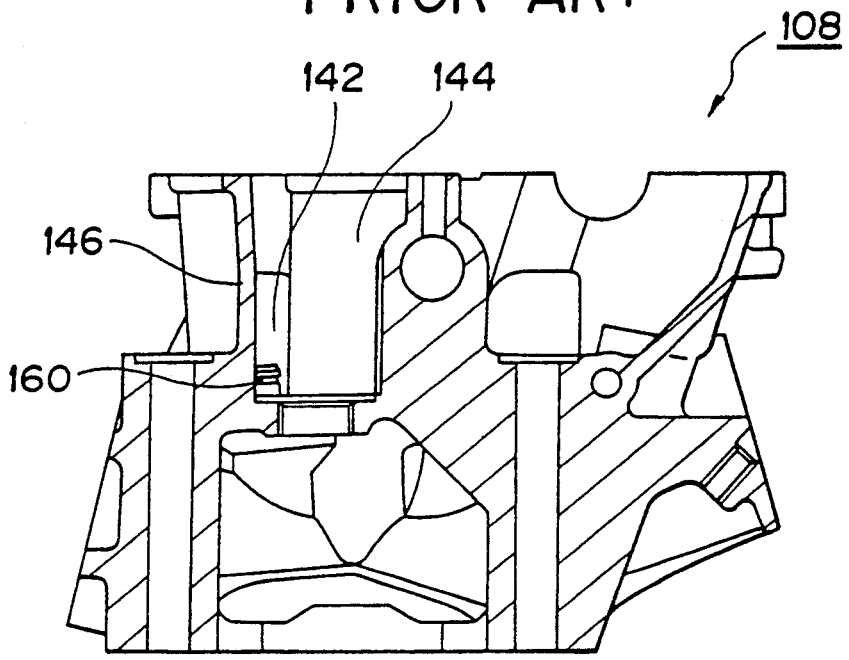
FIG. 9 PRIOR ART
FIG. 9 is a cross-sectional view taken along the line IX—IX in FIG. 8.
Figure 10:
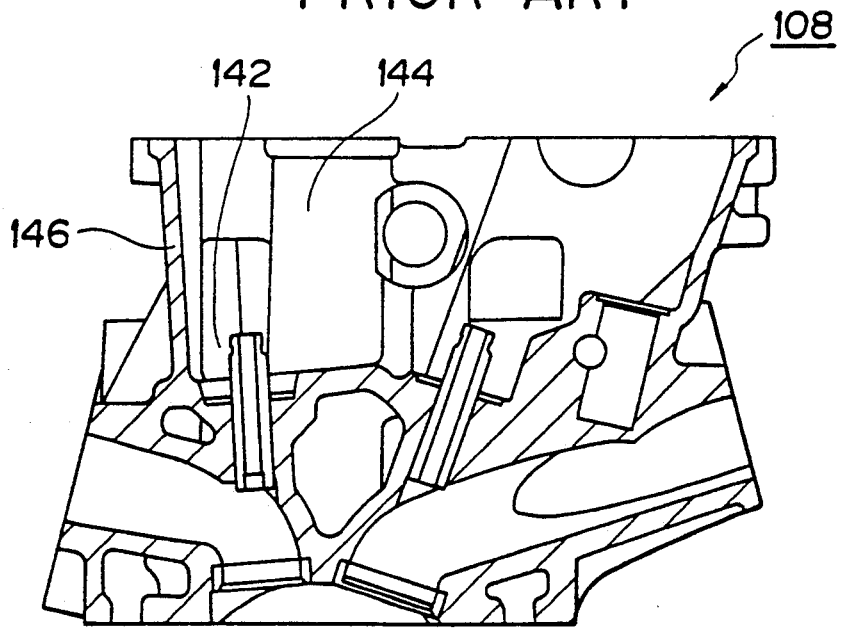
FIG. 10 PRIOR ART
FIG. 10 is a cross-sectional view taken along the line X—X in FIG. 8.
Figure 11:
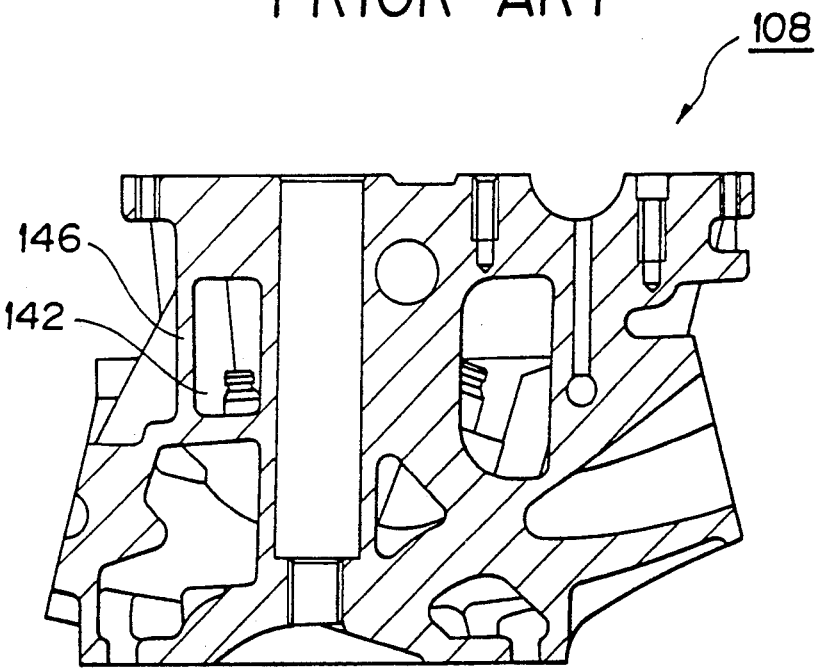
FIG. 11 PRIOR ART
FIG. 11 is a cross-sectional view taken along the line XI—XI in FIG. 8.

Explaining in detail, the cam chamber 44 is formed by the first cylinder head cover 10-1 and the upper portion of the first cylinder head 8-1. A plurality of, for instance four, bolt hole portions 40 for the cylinder head bolts are formed on the exhaust (EX) side (left side in FIG. 3) of the cam chamber 44. As shown in FIG. 1, the bearing surface 40*f* of the bolt hold portion 40 is formed higher by a height H as compared with that of the conventional one (see FIG. 9). A side wall 46 of the cam chamber 44 is projected toward the intake side in a manner similar to the conventional one. Below the elevated bearing surface 40*f* of the bolt hole portion 40, the side wall 46 is moved backward (undercut) toward the exhaust side as shown in FIG. 1, thereby assuring that the oil passage 42 is almost straight and setting the bottom portion of oil passage 42 to a uniform height.

Figure 6:
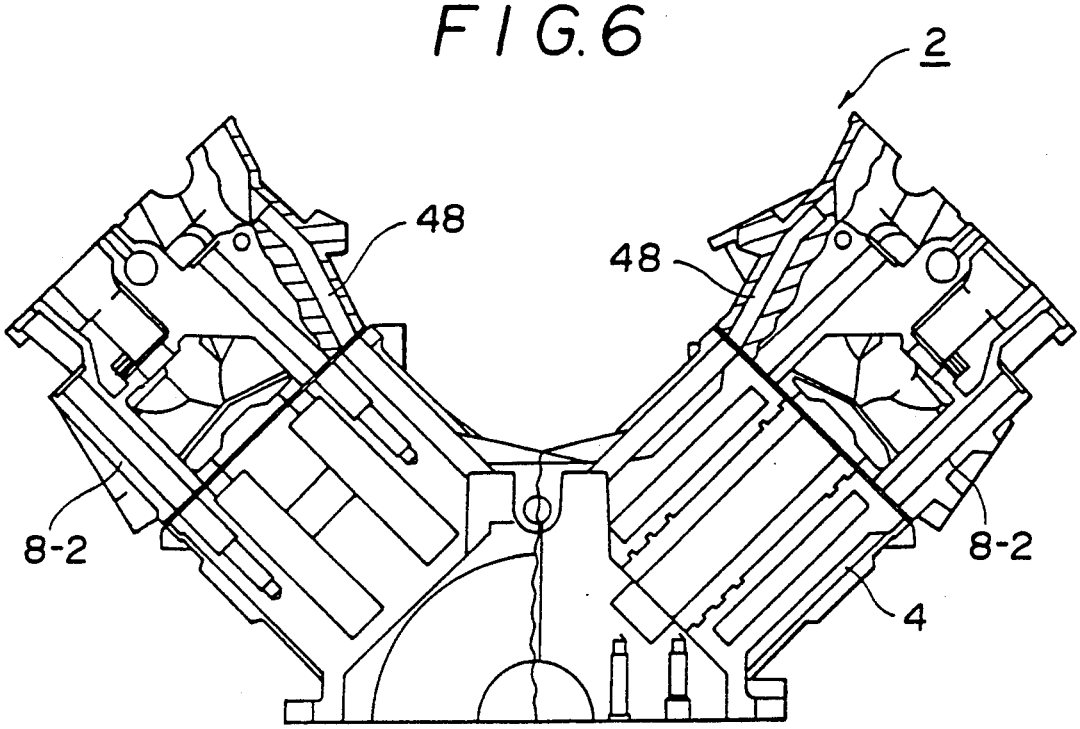
FIG. 6 is a schematic view showing a blow-by gas passage of the V-type engine of FIG. 2.
Figure 7:
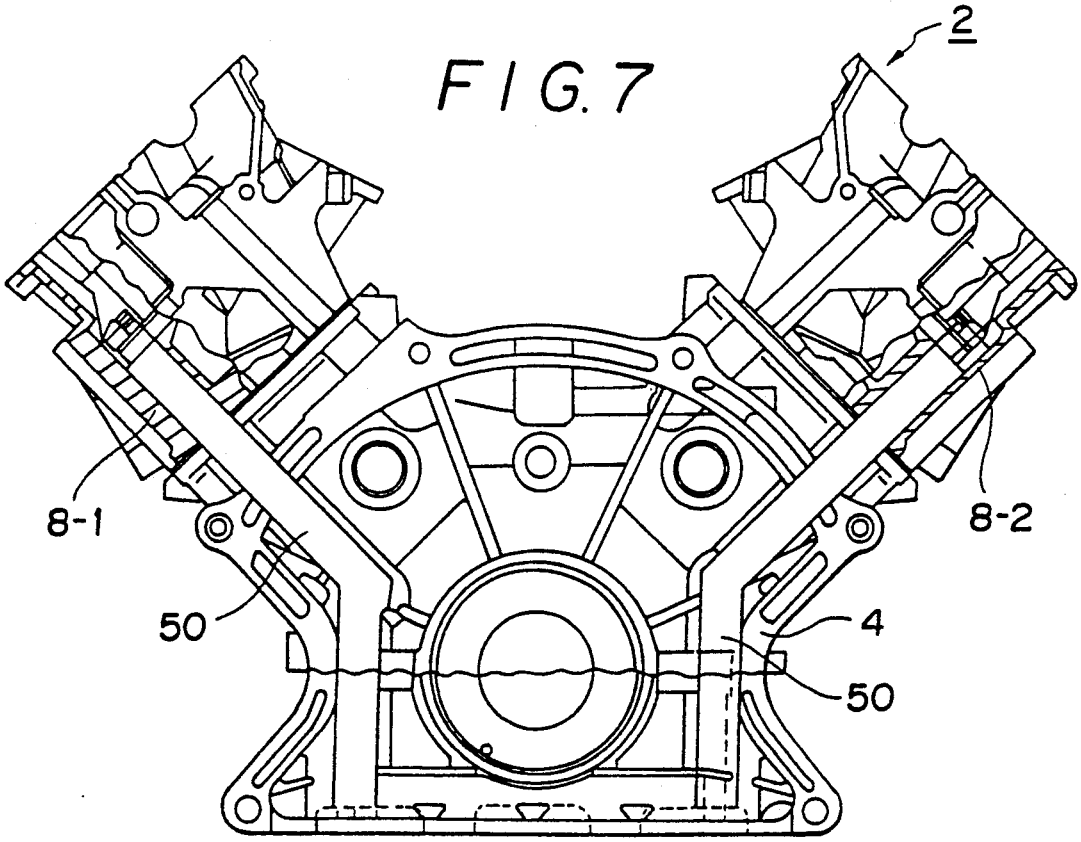
FIG. 7 is a schematic view showing an oil drop passage of the V-type engine of FIG. 2.
Figure 8:
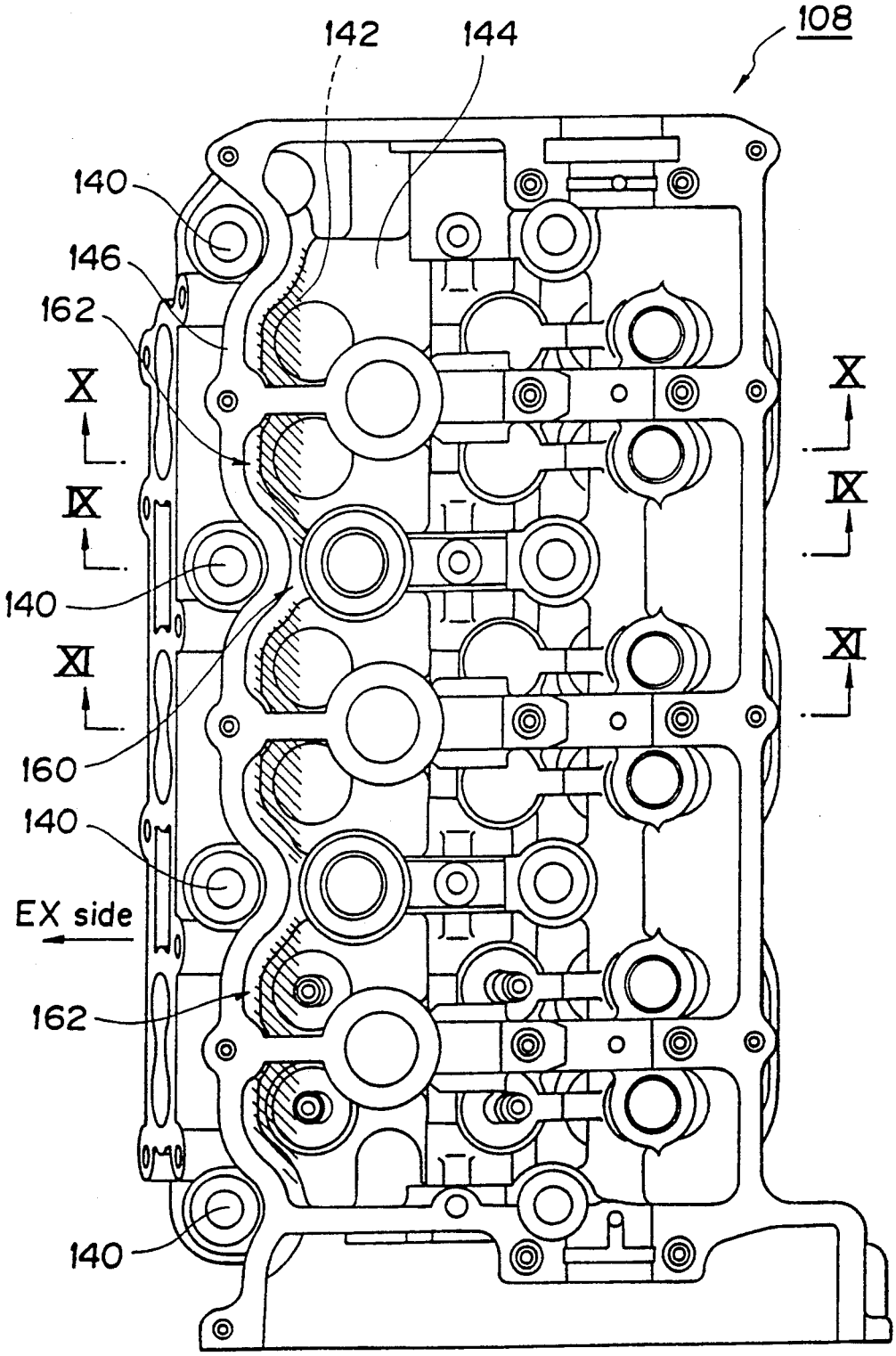
FIG. 8 PRIOR ART
FIG. 8 is a plan view of a cylinder head showing a conventional technique of the invention.

FIG. 6 illustrates blow-by gas passages 48, and FIG. 7 illustrates oil drop passages 50 which drop the oil back into the oil pan 6.

When the V-type engine 2 is operating, the oil in the oil pan 6 is supplied to the oil filter 34 through the first and second communicating passages 32-1 and 32-2 by the oil pump 16 and is supplied to the first oil lubricating passage 36-1 through the third communicating passage 32-3. The oil supplied to the first oil lubricating passage 36-1 is fed to the second oil lubricating passage 36-2 through the fourth communicating passage 32-4 and is supplied to the first rocker arm 26-1 and the first cam shaft 28-1. Oil returns to the oil pan 6 via oil passage 42 and oil drop passage 50. The oil is also supplied to the third oil lubricating passage 36-3 through the fifth communicating passage 32-5 and is supplied to the second rocker arm 26-2 and the second cam shaft 28-2.

The oil in the first oil lubricating passage 36-1 is also supplied to the oil jet 38. A predetermined quantity of oil is supplied from one side injecting portion of the oil jet 38 to a portion of the first piston 18-1 of the first cylinder bank 12-1 arranged on the front side with respect to the progressing direction of the vehicle. A quantity of oil which is larger than the amount of oil which is supplied to the first piston 18-1 is supplied from the injecting portion on the other side of the oil jet 38 to a portion of the second piston 18-2 of the second cylinder bank 12-2 which is arranged on the rear side with respect to the progressing direction of the vehicle.

As shown in FIGS. 1 and 3–5, the oil passage 42 is disposed in the cam chamber 44 on the first cylinder head 8-1. The bottom portion of the oil passage 42 is set to an almost uniform height, so that the oil can smoothly flow. Due to this, inadequate lubrication can be advantageously avoided.

Since a concave portion as in the conventional structure is not formed in the oil passage 42, amounts of precipitation and deposition of dust, sludge and the like which are conveyed by the oil can be reduced. The factors which deteriorate the oil can be avoided. The useful life of the oil can be prolonged.

Further, since the oil smoothly flows in the oil passage 42, the occurrence of aeration wherein air is mixed into the oil can be reduced. The inconveniences which are caused due to the air mixture can be avoided.

Moreover, since the invention can be realized by merely setting the height of bearing surface 40*f* of the bolt hole portion 40 to a large value, the construction is not complicated as compared with the conventional one, manufacturing is easy, and costs are not significantly different.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An internal combustion engine, comprising: an elongated cylinder block having one lateral side defining an exhaust side; an elongated cylinder head detachably affixed to said cylinder block by a plurality of bolts which are located at spaced intervals along said exhaust side of said cylinder block, said cylinder head having an internal cam chamber in the upper portion of said cylinder head and located between the lateral sides of said cylinder head, said cylinder head having a bolt-mounting portion for each of said bolts, said bolt-mounting portions extending laterally outwardly and being disposed along said exhaust side of said cylinder block so that said bolts are externally accessible from said exhaust side, each bolt-mounting portion having a through bore and a bearing surface at the upper end thereof so that a bolt head can bear thereagainst, said cylinder head having an upstanding side wall located between said cam chamber and said bolt-mounting portions and isolating said cam chamber from said bolts, said side wall having a lower portion which extends below and is disposed substantially underneath said bearing surfaces of said bolt-mounting portions, the lower portion of said side wall and said cam chamber defining an oil passage which extends the entire longitudinal extent of said cylinder head along the lower portion of said side wall on the exhaust side of said cylinder head and is isolated from said bolts.

2. A cylinder head as claimed in claim 1 i which said side wall has an upper portion which extends downwardly from the upper end of said cylinder head, and in which said lower portion of said side wall flares laterally outwardly in a downward direction so that said oil passage is of undercut shape and its lower end underlies said bearing surfaces of said bolt-mounting portions.

3. A cylinder head as claimed in claim 2 in which said oil passage has a bottom wall which is of uniform height and is offset downwardly from the bottom of said cam chamber.

* * * * *